US006441714B2

(12) United States Patent
Maeda

(10) Patent No.: US 6,441,714 B2
(45) Date of Patent: Aug. 27, 2002

(54) COIL ELEMENT

(75) Inventor: Osamu Maeda, Osaka (JP)

(73) Assignee: Funai Electric Co., Ltd., Daito (JP)

( * ) Notice: Subject to any disclaimer, the term of this patent is extended or adjusted under 35 U.S.C. 154(b) by 0 days.

(21) Appl. No.: 09/781,156

(22) Filed: Feb. 13, 2001

(30) Foreign Application Priority Data

Apr. 4, 2000 (JP) ..... 2000-002017

(51) Int. Cl.[7] ..... H01F 27/30

(52) U.S. Cl. ..... 336/198; 336/65; 336/208; 336/200

(58) Field of Search ..... 336/65, 180, 185, 336/196, 197, 198, 199, 192, 208, 200

(56) References Cited

U.S. PATENT DOCUMENTS 4,945,332 A * 7/1990 Sakamoto et al. ..... 336/69
6,075,431 A * 6/2000 Honma ..... 336/198

FOREIGN PATENT DOCUMENTS

JP 55-74109 * 6/1980
JP 55-101009 8/1980
JP 61-47611 * 3/1986
JP 61-47612 * 3/1986
JP 4-364009 12/1992
JP 9-121080 * 5/1997
JP 2001-143942 * 5/2001

* cited by examiner

*Primary Examiner*—Lincoln Donovan
*Assistant Examiner*—Tuyen T. Nguyen
(74) *Attorney, Agent, or Firm*—Crowell & Moring LLP

(57) ABSTRACT

A hook constituted by a guide groove formed in a substantially center of a lower surface is provided in a lower portion of a first projection (22), a terminal end (13*a*) of a coil (13) is bent along both right and left side surfaces and a lower surface of the first projection (22), and the terminal end (13*a*) is fitted and inserted to the guide groove at this time, whereby a terminal end treatment of the coil (13) is performed. Further, second projections (24) having a horizontal cross section formed in a rectangular shape are integrally formed in a center left end of a left flange (21) and a center right end of a right flange (21), an inclined surface (24*a*) is formed downward on right side surfaces of both of the second projections (24), and the inclined surface (24*a*) slides an inner peripheral edge of a second through hole at a time of inserting the second projection (24) to a second through hole in a printed circuit board side.

4 Claims, 4 Drawing Sheets

FIG.3
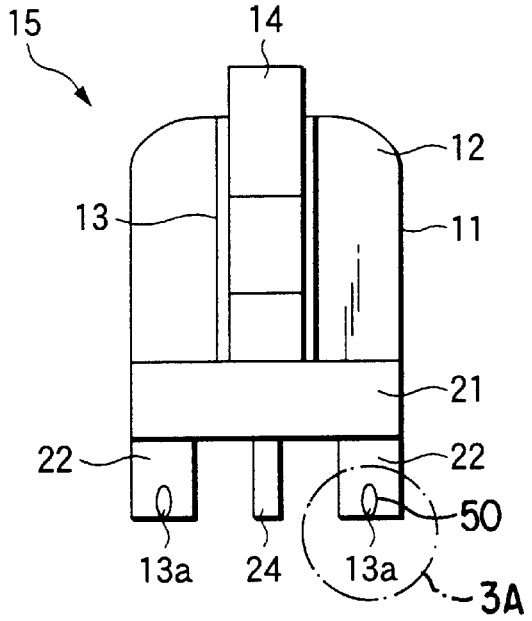
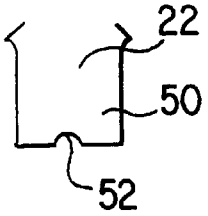
FIG.3A
FIG.4
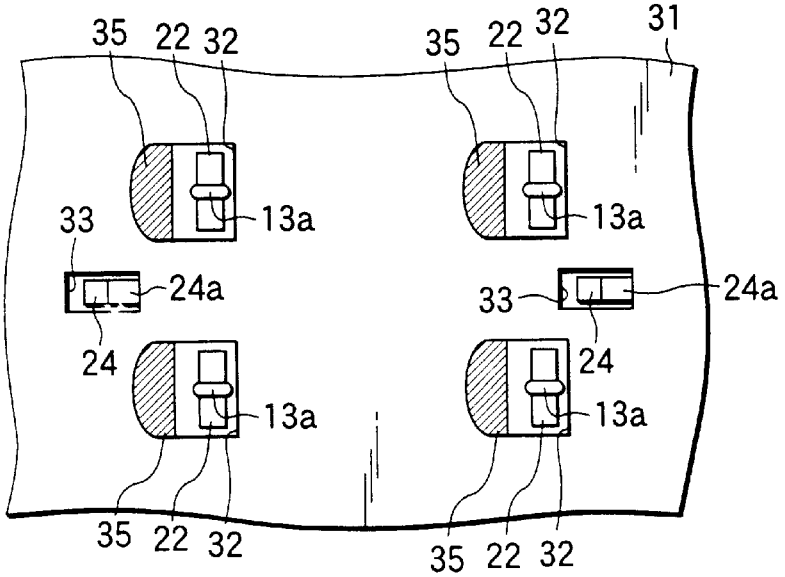

COIL ELEMENT

BACKGROUND OF THE INVENTION

1. Field of the Invention

The present invention relates to a coil element comprising a bobbin and a coil wound around the bobbin and electrically connected to a wiring pattern formed on a printed circuit board.

2. Description of the Related Art

Conventionally, a line filter corresponding to a coil element is structured, for example, as shown in FIGS. 6 to 8. That is, as shown in these drawings, a line filter is constituted by a bobbin 2, a coil 4 wound around right and left portions of the bobbin 2 with respect to a central flange-like partition portion 3 in the bobbin 2, and a ferrite 5 attached to the bobbin 2, and terminal ends 4*a* of the coil 4 are connected to two metal pin terminals 6 provided in both end portion on a lower surface of the bobbin 2.

Then, a coating of the terminal end 4*a* of the coil 4 is removed due to a solder heat, for example, at a time of solder dipping, and the terminal end 4*a* of the connected coil 4 is temporarily welded to the pin terminal 6 by a solder. Thereafter, the terminal end 4*a* is electrically connected to a wiring pattern formed on a printed circuit board (not shown).

At this time, the pin terminal 6 is inserted to a through hole pierced in the printed circuit board and soldered on the wiring pattern of the printed circuit board, mounting of the line filter 1 to the printed circuit board is completed.

However, in this case, since it is necessary to connect the terminal end 4*a* of the coil 4 to the pin terminal 6, an operation therefor is very troublesome, so that there is a problem that a lot of time is required to treat the terminal end of the coil 4. Further, since it is necessary that the metal pin terminal 6 for terminating the coil 4 is provided in the bobbin 2, a cost increase is caused at that degree.

Further, a thickness of the pin terminal 6 is increased by the solder attached at a time of temporary welding, however, when the solder becomes uneven at a time of connecting the terminal end 4*a* of the coil 4, there is a case that only a part of the pin terminal 6 becomes abnormally thick, so that there is generated a disadvantage that it is impossible to easily insert the pin terminal 6 to the through hole when the pin terminal 6 becomes the same thickness as a diameter of the through hole in the printed circuit board side.

In order to prevent the disadvantage mentioned above, it can be considered that the diameter of the through hole in the printed circuit board side is formed larger in order to take into consideration an increased amount of the thickness of the pin terminal 6 due to the temporary welding, however, in such a case, the thickness of the pin terminal 6 becomes even when the solder attached at a time of the temporary welding in a state that the terminal end of the coil 4 is normally treated, so that a gap between the through hole to be inserted and the pin terminal 6 becomes too large. Accordingly, since a lack of solder is generated at a time of soldering the pin terminal 6 to the wiring pattern, there is generated a new problem wherein a stable soldering can not be performed, a crack is easily generated in a solder bridge, and an addition solder operation is required.

Here, with respect to the coil element, the applicant of the present invention has proposed an invention described in Japanese Utility Model No. 3045143, however, in this case, it is necessary to perform a trouble some operation such as to connect the terminal end of the coil to the terminal portion.

SUMMARY OF THE INVENTION

Accordingly, an object of the present invention is to provide a coil element which requires no troublesome treatment of a terminal end of a coil and can electrically connect to a printed circuit board in a stable manner.

In order to achieve the object mentioned above, in accordance with the present invention, there is provided a coil element having a bobbin and a coil wound around the bobbin and electrically connected to a wiring pattern formed on a printed circuit board, comprising:

- a first projection and a second projection formed in the bobbin and respectively inserted to a first through hole and a second through hole pierced in the printed circuit board;
- a hook portion formed in the first projection and with which a terminal end portion of the coil is hooked; and
- pressing means formed in the second projection and pressing the hook portion to one side of an inner periphery of the first through hole in accordance with an insertion to the second through hole.

In accordance with the structure mentioned above, a terminal end treatment can be briefly performed only by hooking the terminal end of the coil with the hook portion of the first projection without necessity of connecting the terminal end of the coil as in the conventional manner, and further since the metal pin terminal is not required to be provided in the bobbin, it is possible to reduce a material cost.

Further, since the hook portion is pressed to one side of the inner periphery of the first through hole by the pressing means at a time of inserting the first and second projections of the bobbin to the first and second through holes of the printed circuit board after hooking the terminal end of the coil with the hook portion, it is possible to securely bring the terminal end of the coil hooked with the hook portion into contact with the wiring pattern by arranging the wiring pattern in a pressing side thereof, so that it is possible to realize a stable electric connection by a soldering or the like performed thereafter.

Further, in accordance with the present invention, the structure is characterized in that the hook portion is provided with a guide groove for the terminal end portion of the coil formed in the first projection, and a solder is applied after the terminal end portion of the coil is hooked with the guide groove.

In accordance with the structure mentioned above, since the guide groove is provided, it is possible to stably hook the terminal end of the coil without being shifted.

Further, in accordance with the present invention, the structure is characterized in that the pressing means is provided with an inclined surface formed on a side surface of the second projection, thereby pressing the hook portion to one side of the inner periphery of the first through hole and in a direction of closing to the wiring pattern due to a cooperation between the inclined surface and the inner peripheral edge of the second through hole at a time of inserting the second projection to the second through hole.

In accordance with the structure mentioned above, since the inclined surface of the second projection slides the inner peripheral edge of the second through hole at a time of inserting the second projection of the bobbin to the second through hole of the printed circuit board, it is possible to easily press the hook portion in the direction of closing to the wiring pattern due to a cooperation between the inclined surface and the inner peripheral edge of the second through hole.

Further, in accordance with the present invention, the structure is characterized in that a distance of incline of the inclined surface is set to a displacement amount for at least pressing the hook portion. In accordance with the structure mentioned above, it is possible to displace the hook portion due to the sliding operation of the inclined surface till the hook portion is just brought in to contact with the wiring pattern, at a time of inserting the second projection to the second through hole, and it is possible to stably perform a soldering operation thereafter.

BRIEF DESCRIPTION OF THE DRAWINGS

FIG. 3 is a side elevational view of a line filter in accordance with the embodiment of the present invention;

FIG. 3A is an enlarged version of the dashed portion of FIG. 3 illustrating a projection having a hook portion and guide groove, without illustrating the terminal end of the coil.

FIG. 4 is a bottom elevational view of a printed circuit board in accordance with the embodiment of the present invention;

DETAILED DESCRIPTION OF THE PREFERRED EMBODIMENTS

Figure 5:
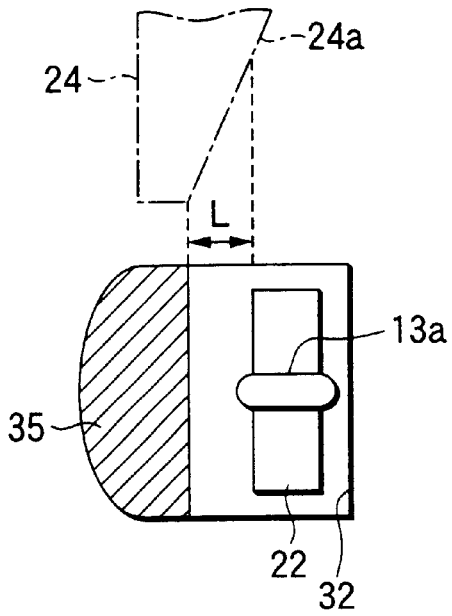
FIG. 5 is a schematic view explaining an operation of the embodiment in accordance with the present invention.
Figure 6:
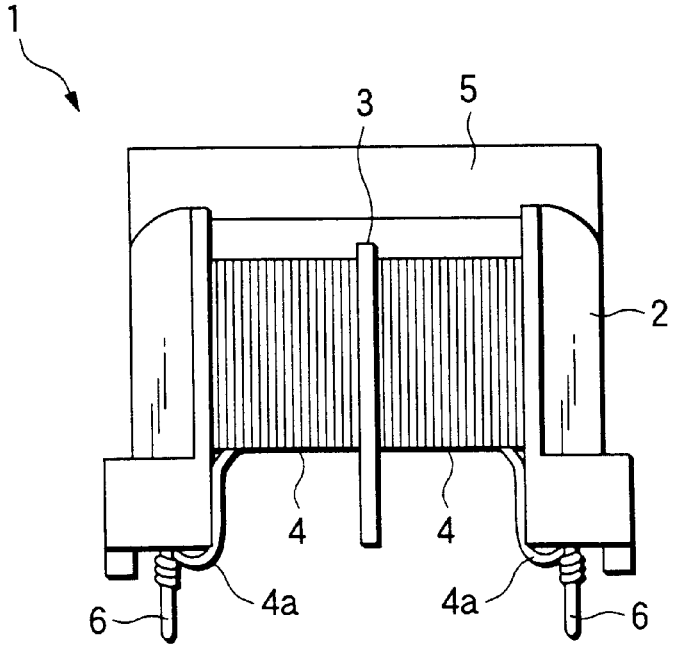
FIG.6 PRIOR ART
FIG. 6 is a front elevational view of a conventional example.
Figure 7:
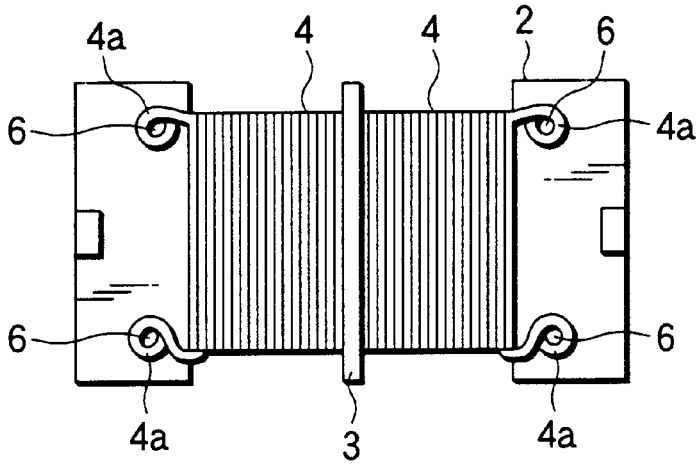
FIG.7 PRIOR ART
FIG. 7 is a bottom elevational view of the conventional example.
Figure 8:
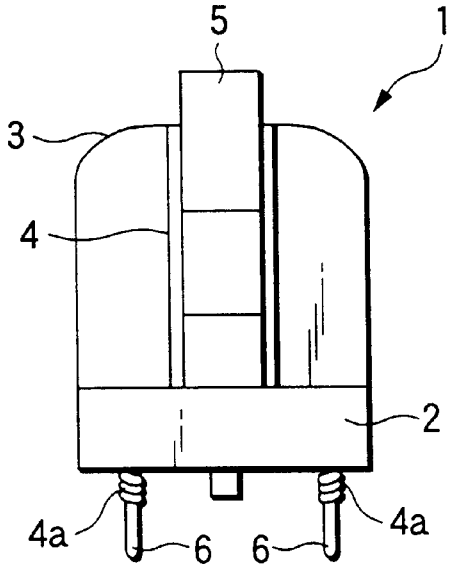
FIG.8 PRIOR ART
FIG. 8 is a side elevational view of the conventional example.

A description will be given of an embodiment in the case that the present invention is applied to a line filter corresponding to a coil element with reference to FIGS. 1 to 5. In this case, FIGS. 1 to 3 are respectively a front elevational view, a bottom elevational view and a side elevational view of the line filter, FIG. 4 is a bottom elevational view of a printed circuit board, and FIG. 5 is a schematic view explaining an operation.

Figure 1:
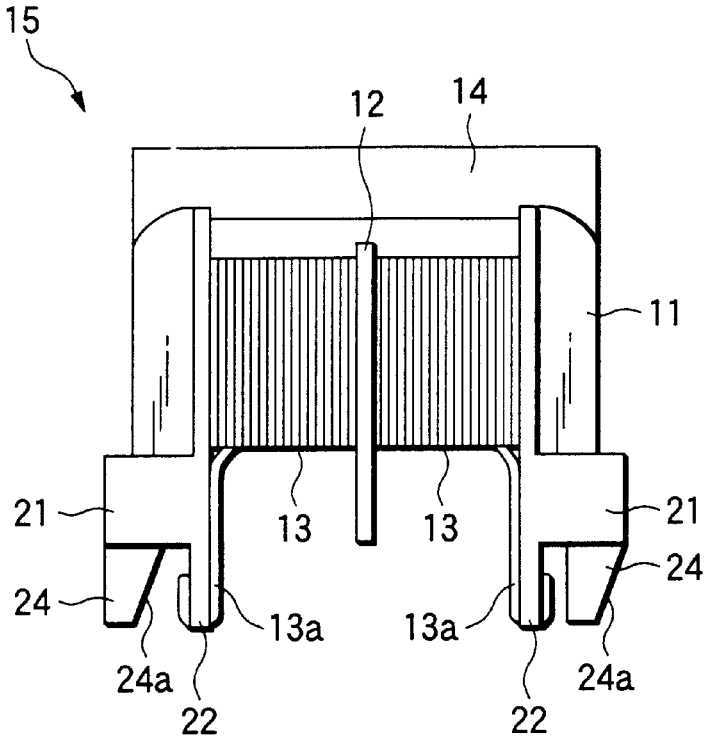
FIG. 1 is a front elevational view of a line filter in accordance with an embodiment of the present invention.
Figure 2:
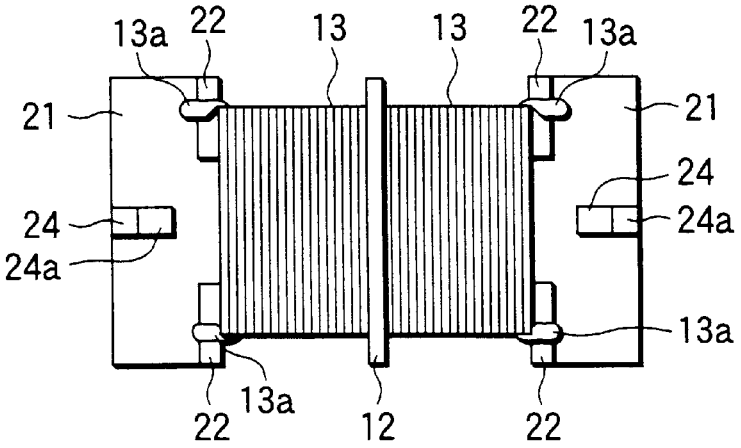
FIG. 2 is a bottom elevational view of a line filter in accordance with the embodiment of the present invention.

As shown in FIGS. 1 to 3, a bobbin 11 is formed by molding a heat resisting resin such as a phenol resin, a polybutylene terephthalate or a polyethylene terephthalate, and the like, a coil 13 is wound around right and left sides of a bobbin 11 with respect to a flange-like partition portion 12 disposed in a center of the bobbin 11, and a ferrite 14 is mounted to the bobbin 11, whereby a line filter 15 is constructed.

In this bobbin 11, flange portions 21 are integrally formed in right and left lower end portions, and first projections 22 protruding downward and formed in a rectangular parallelepiped shape are integrally formed in total four portions comprising front and rear portions of a right end of the left flange portion 21 and front and rear portions of a left end of the right flange portion 21. Further, although not clearly illustrated, a hook portion 50 constituted by a guide groove 52 formed in a substantially center portion of a lower surface is provided in a lower portion of each of the first projections 22, a terminal end 13*a* of the coil 13 is bent along both right and left side surfaces and a lower surface of the first projection 22, and the terminal end 13*a* is fitted and inserted to the guide groove, whereby the terminal end of the coil 13 is treated.

Further, second projections 24 having a horizontal cross section formed in a rectangular shape are integrally formed in a center left end portion of the left flange portion 21 and a center right end portion of the right flange portion 21. Inclined surfaces 24*a* directed downward are formed on right side surfaces of the second projections 24, and the second projections 24 are formed in a wedge shape.

Further, in a state that the terminal end 13*a* of the coil 13 is hooked with the guide groove of each of the first projections 21, the lower portion of the bobbin 11 is soaked into a solder dip tank, whereby a coating of the terminal end 13*a* of the coil 13 is removed due to a heat of the solder and at the same time, the solder is attached to the terminal end 13*a* of the coil 13 so as to be terminated, thereby being treated so as to easily solder with a wiring pattern on a printed circuit board mentioned below.

In this case, as shown in FIG. 4, four rectangular through holes 32 are pieced at positions respectively corresponding to the first projections 22 of the bobbin 11 on a printed circuit board 31, and two rectangular through holes 33 are pieced at positions corresponding to both of the second projections 24. Each of these through holes 32 and 33 is substantially similar shape to each of the projections 22 and 24, and is formed so as to be slightly larger than each of the projections 22 and 24, thereby being structured so as to correspond to a size error at a time of manufacturing and assembling. In this case, in FIG. 4, reference numeral 35 denotes a copper foil wiring pattern formed in adjacent to each of the first through holes 32.

At this time, as shown in FIG. 5, it is desirable to set a distance of incline of the inclined surface 24*a* of the second projection 24 to a displacement amount L for at least pressing the first projection 22. When the structure is made above, the inclined surface 24*a* slides an inner peripheral edge of the second through hole 33 at a time of inserting the second projection 24 to the second through hole 33 in the side of the printed circuit board 31, whereby the first projection 22 is displaced till the terminal end 13*a* of the coil 13 is just brought into contact with the wiring pattern 35. As a result, during a thereafter soldering process, the terminal end 13*a* of the coil 13 is stably soldered with the wiring pattern 35 and no additional solder is required.

Accordingly, in accordance with the embodiment mentioned above, since it is sufficient to hook the terminal end 13*a* of the coil 13 with the guide groove of the first projection 22 in the bobbin, it is not required to connect the terminal end 13*a* of the coil 13 in accordance with the conventional manner, so that it is possible to simply treat the terminal end of the coil 13 and it is not necessary to provide with the metal pin terminal in the bobbin 11 in accordance with the conventional manner. Accordingly, it is possible to reduce a material cost.

Further, since it is possible to press the first projection 22 to one side of the inner periphery of the first through hole 32 by the inclined surface 24*a* of the second projection 24 corresponding to the pressing means at a time of inserting the first and second projections 22 and 24 of the bobbin 11 to the first and second through holes 32 and 33 of the printed circuit board 31 after hooking the terminal end 13*a* of the coil 13 with the guide groove, it is possible to securely bring the terminal end 13*a* of the coil 13 into contact with the wiring pattern 35, whereby it is possible to realize a stable electric connection by a thereafter soldering or the like.

Further, since the hook portion constituted by the guide groove is provided in the lower portion of the first projection 22, it is possible to stably hook the terminal end 13*a* of the coil 13 without being shifted, whereby it is possible to improve an operation efficiency for treating the terminal end.

In this case, in the embodiment mentioned above, the description is given on the assumption that the hook portion is constituted by the guide groove, however, the structure is not particularly limited to the structure constituted by the guide groove, and the position thereof is not limited to the lower portion of the first projection 22. In a word, it is sufficient to employ a structure which can hook the terminal end 13*a* of the coil 13 without connecting.

Further, in the embodiment mentioned above, it is of course that the shape and the number of the first projection and the second projection are not limited to those of the embodiment mentioned above.

Further, the description is given of the case of setting the coil part to the line filter, however, the structure to which the present invention can be applied is not limited to this, and it is of course that the present invention can be applied to the other coil element such as a transformer or the like. The same effects as those of the embodiment mentioned above can be obtained.

Further, the present invention is not limited to the embodiment mentioned above, and various modifications other than the structure mentioned above can be applied within the scope of the present invention.

As mentioned above, in accordance with the invention according to the first aspect, the terminal end treatment can be briefly performed only by hooking the terminal end of the coil with the hook portion of the first projection without necessity of connecting the terminal end of the coil as in the conventional manner.

Further since the metal pin terminal is not required to be provided in the bobbin as in the conventional manner, it is possible to reduce a material cost and it is possible to provide an inexpensive coil element.

Further, since the hook portion is pressed to one side of the inner periphery of the first through hole by the pressing means at a time of inserting the first and second projections of the bobbin to the first and second through holes of the printed circuit board after hooking the terminal end of the coil with the hook portion, it is possible to securely bring the terminal end of the coil hooked with the hook portion into contact with the wiring pattern by arranging the wiring pattern in a pressing side thereof, so that it is possible to realize a stable electric connection by a soldering or the like performed thereafter.

Further, in accordance with the invention according to the second aspect, since the guide groove is provided, it is possible to stably hook the terminal end of the coil without being shifted, so that it is possible to improve an operation efficiency of the terminal end treatment.

Further, in accordance with the invention according to the third aspect, since the inclined surface of the second projection slides the inner peripheral edge of the second through hole at a time of inserting the second projection of the bobbin to the second through hole of the printed circuit board, it is possible to easily press the hook portion in the direction of closing to the wiring pattern due to a cooperation between the inclined surface and the inner peripheral edge of the second through hole.

Further, in accordance with the invention according to the fourth aspect, it is possible to displace the hook portion due to the sliding operation of the inclined surface till the hook portion is just brought into contact with the wiring pattern, at a time of inserting the second projection to the second through hole, and it is possible to stably perform a soldering operation thereafter.

What is claimed is:

1. A coil element having a bobbin and a coil wound around the bobbin and electrically connected to a wiring pattern formed on a printed circuit board, said coil element comprising:

a first projection and a second projection formed in said bobbin and respectively inserted to a first through hole and a second through hole pierced in said printed circuit board, said first through hole having the wiring pattern formed on one side of the inner periphery thereof;

a hook portion formed in said first projection and with which a terminal end portion of said coil is hooked; and a pressing member formed in said second projection, wherein said pressing member has an inclined surface interacting with an inner peripheral edge of said second through hole when inserted therein such that the bobbin is displaced over a surface of the printed circuit board in order to press the terminal end portion of said coil hooked over the hook portion of said first projection against the wiring pattern formed on one side of the inner periphery of said first through hole.

2. The coil element according to claim 1, wherein said hook portion is provided with a guide groove for the terminal end portion of said coil formed in said first projection, and a solder is applied after the terminal end portion of said coil is hooked with the guide groove.

3. The coil element according to claim 1, wherein an offset distance of said inclined surface is set to correspond with a displacement amount needed to press said hook portion against said wiring pattern.

4. The coil element according to claim 1, wherein a plurality of second projections are formed on the bobbin, each having an inclined surface oriented in a same direction to cause a displacement of the bobbin over the surface of the printed circuit board when inserted into respective second through holes.

* * * * *